US008740365B2

(12) United States Patent
Uezawa et al.

(10) Patent No.: US 8,740,365 B2
(45) Date of Patent: Jun. 3, 2014

(54) LIQUID EJECTING HEAD, LIQUID EJECTING HEAD UNIT AND LIQUID EJECTING APPARATUS

(75) Inventors: Haruhisa Uezawa, Shiojiri (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 13/526,299

(22) Filed: Jun. 18, 2012

(65) Prior Publication Data

US 2012/0256989 A1 Oct. 11, 2012

(51) Int. Cl.
*B41J 2/18* (2006.01)
*B41J 2/045* (2006.01)

(52) U.S. Cl.
USPC ..... 347/89; 347/68

(58) Field of Classification Search
None
See application file for complete search history.

(56) References Cited

U.S. PATENT DOCUMENTS

2008/0143793 A1 6/2008 Okuda
2008/0238980 A1* 10/2008 Nagashima et al. ..... 347/17

FOREIGN PATENT DOCUMENTS

| | | | |
|---|---|---|---|
| JP | 06-008467 | A | 1/1994 |
| JP | 3097321 | B2 | 8/2000 |
| JP | 2007-535431 | A | 12/2007 |
| JP | 2008-055716 | A | 3/2008 |
| JP | 2008-149579 | A | 7/2008 |
| JP | 2008-279711 | A | 11/2008 |
| JP | 2009-247938 | A | 10/2009 |
| JP | 2011-201222 | A | 10/2011 |
| WO | 2005/108097 | A1 | 11/2005 |
| WO | 2009/143362 | A1 | 11/2009 |

* cited by examiner

*Primary Examiner* — Geoffrey Mruk
(74) *Attorney, Agent, or Firm* — Kilpatrick Townsend & Stockton LLP

(57) ABSTRACT

A liquid ejecting head includes a liquid channel having a pressure generating chamber communicated with a nozzle opening that ejects liquid, and a first liquid chamber installed at one end of the pressure generating chamber to communicate a plurality of pressure generating chambers; a pressure generating unit for changing pressure in the pressure generating chamber so that liquid is discharged from the nozzle opening; a heating unit for heating liquid in the liquid channel at an upstream of the pressure generating chamber; a second liquid chamber installed at the other end of the pressure generating chamber; and a circulating channel formed among a pressure generating chamber group having at least one pressure generating chamber to connect the first liquid chamber and the second liquid chamber.

19 Claims, 5 Drawing Sheets

LIQUID EJECTING HEAD, LIQUID EJECTING HEAD UNIT AND LIQUID EJECTING APPARATUS

The entire disclosure of Japanese Patent Application No: 2010-072414, filed Mar. 26, 2010 are expressly incorporated by reference herein.

BACKGROUND

1. Technical Field

The present invention relates to a liquid ejecting head which ejects liquid from a nozzle opening, a liquid ejecting head unit and a liquid ejecting apparatus.

2. Related Art

An ink jet-type printing head, which is a representative example of a liquid ejecting head for ejecting liquid droplets, includes for example a channel-forming substrate having a pressure generating chamber, and a piezoelectric element installed at one surface of the channel-forming substrate, and the ink jet-type printing head creates pressure in the pressure generating chamber by means of displacement of the piezoelectric element. The ink jet-type printing head may eject ink droplets through a nozzle opening.

Also, two reservoirs commonly communicated with a plurality of pressure generating chambers may be provided such that ink may be supplied from an ink tank to the two reservoirs (e.g., see Japanese Patent No. 3097321).

Further, there is also provided an ink jet-type printing head, which has a liquid channel in the head for flowing a warm water in an installation direction of the pressure generating chambers such that the ink in each of the pressure generating chambers is heated by the warm water flowing in the liquid channel in the head (e.g., see JP-A-2008-55716).

By using this, the ink in the pressure generating chamber is heated to decrease viscosity, thereby improving ink discharging characteristics.

However, in Japanese Patent No. 3097321, just two reservoirs are provided, but the ink in the pressure generating chamber is not heated, the ink in two reservoirs are not circulated, and also it is impossible to discharge ink with desired ink discharging characteristics.

In addition, where only the liquid channel in the head is provided to flow warm water in the installation direction of the pressure generating chambers as in JP-A-2008-55716, the heating temperature is not uniform at both ends of the pressure generating chambers in an installation direction but generates a temperature gradient, so variation occurs in the discharging characteristics of the ink discharged from each nozzle opening, thereby deteriorating the printing quality.

Further, it is substantially not easy to provide a heating unit to every channel of the pressure generating chambers or the like, and the ink near the nozzle opening is insufficiently heated, so it is impossible to discharge a sufficiently heated ink with excellent discharging characteristics.

In addition, such problems occur not only in the ink jet-type printing head but also in a liquid ejecting head that ejects liquid other than ink.

SUMMARY

An advantage of some aspects of the invention is to provide a liquid ejecting head which heats liquid in all pressure generating chambers at a substantially uniform temperature to obtain uniform liquid ejecting characteristics and thus improve the printing quality, a liquid ejecting head unit and a liquid ejecting apparatus.

According to an aspect of the invention, there is provided a liquid ejecting head, which includes a liquid channel having a pressure generating chamber communicated with a nozzle opening that ejects liquid, and a first liquid chamber installed at one end of the pressure generating chamber to communicate a plurality of pressure generating chambers; a pressure generating unit for changing pressure in the pressure generating chamber so that liquid is discharged from the nozzle opening; a heating unit for heating liquid in the liquid channel at an upstream of the pressure generating chamber; a second liquid chamber installed at the other end of the pressure generating chamber; and a circulating channel formed among a pressure generating chamber group having at least one pressure generating chamber to connect the first liquid chamber and the second liquid chamber.

In this aspect, the circulating channel for flowing a heated liquid is provided in addition to the pressure generating chambers, so the liquid in all pressure generating chambers may be heated to a uniform temperature, even near the nozzle opening. In this way, the viscosity of liquid may be controlled to obtain improved and uniform liquid discharging characteristics.

Here, it is preferable that a protrusion protruded in a direction orthogonal to a direction along which the liquid is to flow is installed at the circulating channel. In this configuration, a contact area of the liquid flowing along the circulating channel is increased to improve thermal conductivity, so it is possible to efficiently heat the liquid in the pressure generating chambers to a desired temperature within a short time.

Also, it is preferable that the pressure generating chamber is formed as a concaved portion at one side of a channel-forming substrate without penetrating through the channel-forming substrate in a thickness direction and at the same time has a concaved shape opening at one side, and that the circulating channel has an extending installation portion extending to a region facing the pressure generating chamber in a thickness direction of the channel-forming substrate. In this configuration, the extending installation portion is provided in the region where the pressure generating chambers face each other, so the thermal conductivity is further improved to efficiently heat to a desired temperature within a short time.

In addition, it is preferable that the circulation channel is installed between the pressure generating chambers adjacent to each other. In this configuration, the liquid in all pressure generating chambers may be heated at a uniform temperature.

Also, the pressure generating chamber group may include two pressure generating chambers. In this configuration, the channel-forming substrate may be designed to have a smaller size, and the liquid ejecting head may also be designed to have a smaller size.

In addition, it is preferable that a liquid flow forming unit for generating a flow of liquid from the first liquid chamber through the circulation channel to the second liquid chamber is installed in the liquid channel. In this configuration, the liquid may be circulated from the first liquid chamber through the circulation channel to the second liquid chamber.

According to another aspect of the invention, there is provided a liquid ejecting head unit, which includes at least two liquid ejecting heads of the above aspect.

In this aspect, the liquid ejecting characteristics of the liquid discharged from every nozzle opening may be made uniform.

According to still another aspect of the invention, there is provided a liquid ejecting apparatus including the liquid ejecting head or the liquid ejecting head unit of the above aspect.

In this aspect, the liquid ejecting characteristics of the liquid discharged from every nozzle opening are made uniform, so it is possible to realize a liquid ejecting apparatus with improved printing quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention is described based on embodiments.

First Embodiment

Figure 1A:
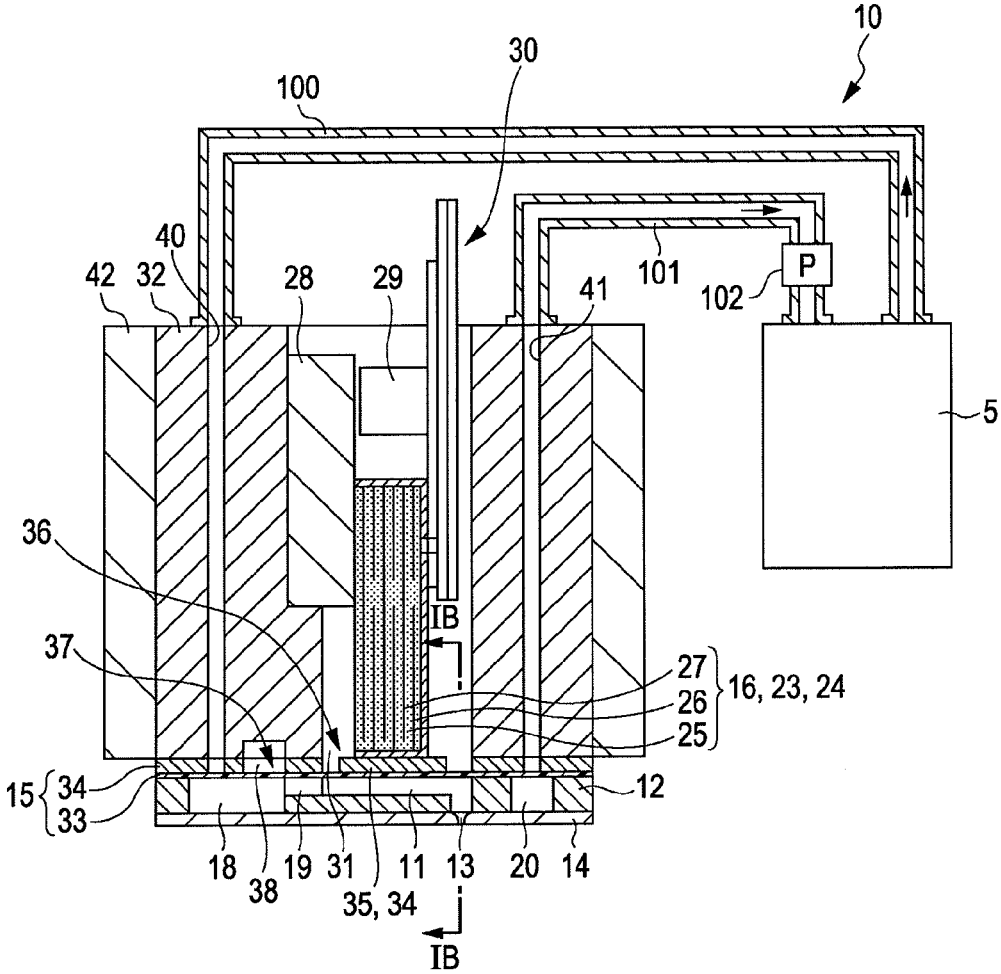
FIGS. 1A and 1B are sectional views showing a printing head according to a first embodiment.
Figure 1B:
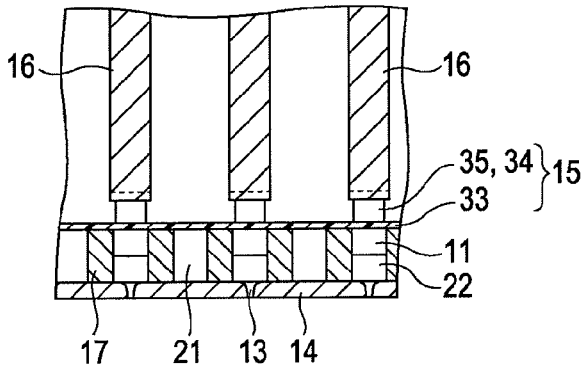
Figure 2:
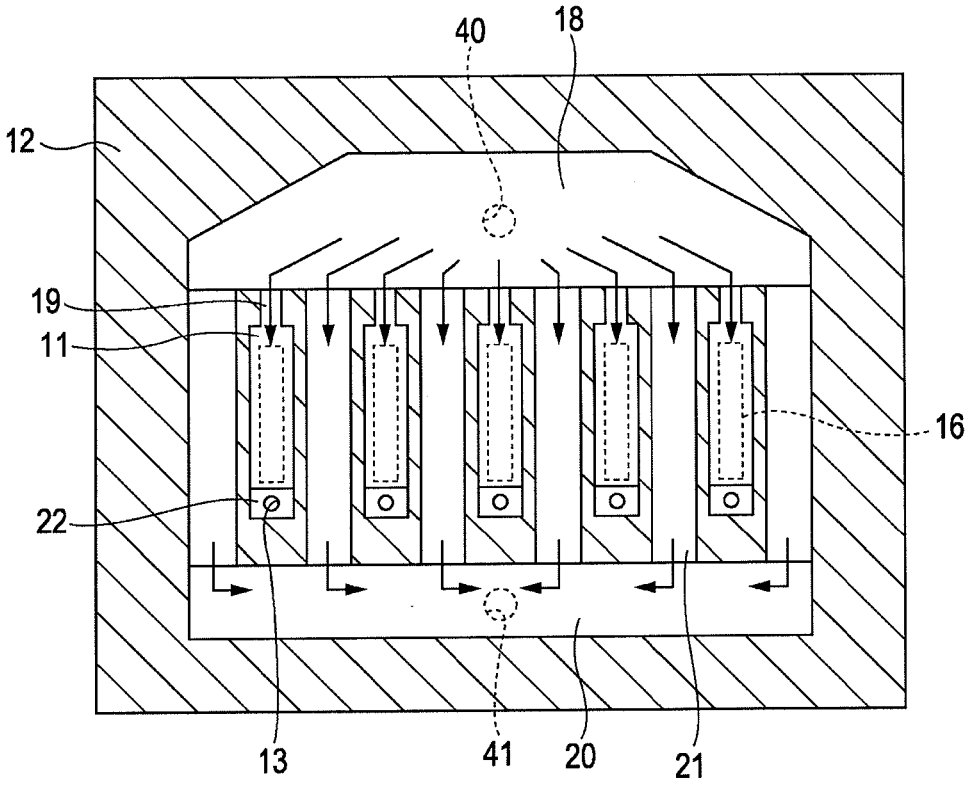
FIG. 2 is a plane view showing a channel-forming substrate according to the first embodiment.

FIGS. 1A and 1B are sectional views showing an ink jet-type printing head, which is one example of a liquid ejecting head according to a first embodiment of the invention, and FIG. 2 is a plane view showing a channel-forming channel.

As shown in FIGS. 1A and 1B, the ink jet-type printing head 10 of this embodiment includes a channel-forming substrate 12 to which a plurality of pressure generating chambers 11 are installed, a nozzle plate 14 in which a plurality of nozzle openings 13 individually communicated with the pressure generating chambers 11 are formed, a vibration plate 15 installed to a surface of the channel-forming channel 12 opposite to the nozzle plate 14, and a piezoelectric element 16 installed on the vibration plate 15.

To the channel-forming substrate 12, the plurality of pressure generating chambers 11 are partitioned by barriers 17 and installed in its width direction as shown in FIGS. 1A, 1B and 2. Also, at one end of the pressure generating chamber 11 of the channel-forming substrate 12 in a length direction, a manifold 18 serving as a first liquid chamber is installed through the channel-forming substrate 12. In addition, the manifold 18 is connected to each pressure generating chamber 11 via an ink supply path 19, respectively. In this embodiment, the ink supply path 19 has a narrower width than the pressure generating chamber 11, so the ink supply path 19 plays a role of constantly maintaining a channel resistance of ink introduced to the pressure generating chamber 11 from the manifold 18.

Meanwhile, a circulating liquid chamber 20 serving as a second liquid chamber is installed to the other end of the pressure generating chamber 11 of the channel-forming substrate 12 in a length direction. The manifold 18 is communicated with the circulating liquid chamber 20 by means of a plurality of circulating channels 21 formed in the channel-forming substrate 12 respectively. The circulating channel 21 is formed among a pressure generating chamber group having at least one pressure generating chamber 11. In this embodiment, the circulating channels 21 are provided at both sides of each pressure generating chamber 11, in other words both outer sides of a row of pressure generating chambers 11 and between adjacent pressure generating chambers 11, respectively. In other words, in this embodiment, the pressure generating chamber group has one pressure generating chamber 11. Also, it is possible that the pressure generating chamber group has two pressure generating chambers 11, and the circulating channel 21 is provided in the every other pressure generating chamber group, in other words between adjacent pressure generating chambers 11. The number of pressure generating chambers 11 in the pressure generating chamber group may be 3 or more, but the pressure generating chamber group preferably has two or fewer pressure generating chambers 11 since the ink in the pressure generating chamber 11 is heated by the heated ink flowing through the circulating channel 21.

Each circulation channel 21 is formed with a substantially constant width between the manifold 18 and the circulation liquid chamber 20. For example, in this embodiment, each circulation channel 21 is formed with substantially same width as the pressure generating chamber 11 and through the channel-forming substrate 12.

Also, in this embodiment, the pressure generating chamber 11 is formed without passing through the channel-forming substrate 12, so a nozzle opening communication path 22 communicated with the nozzle opening 13 through the channel-forming substrate 12 is formed at an end of the pressure generating chamber 11 opposite to the manifold 18.

A nozzle plate 14 is joined to one surface of the channel-forming substrate 12. Also, each nozzle opening 13 is communicated with each pressure generating chamber 11 via the nozzle opening communication path 22 installed at the channel-forming substrate 12 as described above. In addition, a vibration plate 15 is joined to the other surface of the channel-forming substrate 12, in other words to an opening surface of the pressure generating chamber 11, so that the pressure generating chamber 11, the circulating channel 21, the manifold 18 and the circulation liquid chamber 20 are sealed by the vibration plate 15. Also, a piezoelectric element 16 is fixed on the vibration plate 15 in correspondence with the pressure generating chamber 11 in a state in which its front end is contacted. The piezoelectric element 16 is configured such that an inactive region where individual inner electrodes 26 and common inner electrodes 27 are laminated in turns on a piezoelectric material layer 25 and which does not contribute to piezoelectric deformation is attached to a fixed substrate 28. Also, to the inactive region of the piezoelectric element 16, a driving wiring 30 on which a driving IC 29 is loaded is connected.

In addition, a head case 32 having a receiving unit 31 receiving the piezoelectric element 16 serving as a pressure generating unit to change pressure in the pressure generating chamber 11 in the state of being fixed to the fixed substrate 28 is fixed on the vibration plate 15. A supply communication path 40 communicated with the manifold 18 and a retrieving communication path 41 communicated with the circulation liquid chamber 20 are installed to the head case 32. Also, a liquid storage 5 is connected to the supply communication path 40 and the retrieving communication path 41 via a supply pipe 100 and a retrieving pipe 101, respectively. The liquid storage 5 is configured with an ink tank storing ink or the like, and the ink is supplied from the liquid storage 5 to the manifold 18 via the supply pipe 100 and the supply communication path 40. In addition, the ink supplied to the manifold 18 is filled in the circulation liquid chamber 20 via the circulation channel 21, and the ink in the circulation liquid chamber 20 is retrieved to the liquid storage 5 via the retrieving communication path 41 and the retrieving pipe 101. In other words, in this embodiment, a circulating liquid channel including the supply pipe 100, the retrieving pipe 101 and the channel of each ink jet-type printing head 10 (for example, the manifold 18, the circulation channel 21, the circulation liquid chamber 20, and so on) for circulating the ink of the liquid storage 5 is installed. In addition, the liquid channel of the ink jet-type printing head 10 of this embodiment has the supply communication path 40, the retrieving communication path 41, the manifold 18, the ink supply path 19, the pressure generating chamber 11, the circulation liquid chamber 20 and the circulating channel 21.

Also, a pump 102 is installed in the middle of the retrieving pipe 101 so that the ink from the liquid storage 5 is circulated due to the pressure of the pump 102. In other words, in this embodiment, the pump 102 serves as a liquid flow forming unit for forming a flow of ink to the circulation liquid chamber 20 through the circulation channel 21 from the manifold 18.

Further, a heating unit 42 such as an electric heater for heating the ink passing through the supply communication path 40 installed in the head case 32 is installed at an outer periphery of the head case 32. The heating unit 42 heats the ink passing in the supply communication path 40 and supplies the heated ink to the manifold 18. In other words, the heating unit 42 heats the ink flowing through the supply communication path 40, which is upstream of the pressure generating chamber 11 of the liquid channel of the ink jet-type printing head 10. In addition, the heating unit 42 for heating ink may be provided in the channel other than at the outer periphery of the head case 32, but in this case the channel is very small and the heating unit 42 should also be designed with a small size, so the small heating unit 42 may not sufficiently heat the ink flowing in the channel. In addition, it is also possible to provide a heating unit in the liquid storage 5 such that a heated ink is supplied to the head case 32.

Also, the vibration plate 15 to which the front end of the piezoelectric element 16 is contacted is configured with a composite plate including for example an elastic membrane 33 made of an elastic member such as resin film and for example a support plate 34 made of metal material and supporting the elastic membrane 33, so that the elastic membrane 33 is joined to the channel-forming substrate 12. In addition, in a region of the vibration plate 15 opposite to each pressure generating chamber 11, an island portion 35 to which the front end of the piezoelectric element 16 is contacted is installed. In other words, a thin portion 36 with a smaller thickness than other regions is formed in a region of the vibration plate 15 opposite to the periphery of each pressure generating chamber 11, so the island portion 35 is installed at an inner side of the thin portion 36, respectively.

Also, in a region of the vibration plate 15 opposite to the manifold 18, a compliance portion 37 substantially having only the elastic membrane 33 by removing the support plate 34 similarly to the thin portion 36 is installed. In a region of the head case 32 opposite to the compliance portion 37, a space 38 allowing deformation of the compliance portion 37 is formed.

In this ink jet-type printing head 10, the ink is supplied from the liquid storage 5 via the supply pipe 100 to the supply communication path 40. The ink supplied to the supply communication path 40 is heated by the heating unit 42 and supplied to the manifold 18. The heated ink supplied to the manifold 18 is partially supplied to the pressure generating chamber 11 to change a volume of the pressure generating chamber 11 by driving the piezoelectric element 16 at a desired timing, thereby discharging ink droplets from the nozzle opening 13. In addition, the heated ink of the manifold 18 is supplied to the circulation liquid chamber 20 via the circulation channel 21 by the pressure of the pump 102 and then retried to the liquid storage 5 from the circulation liquid chamber 20 via the retrieving communication path 41 and the retrieving pipe 101. At this time, in this embodiment, the heated ink is circulated via the circulation channel 21 installed between adjacent pressure generating chambers 11, so the ink in each pressure generating chamber 11 may be heated at a uniform temperature by means of the heated ink flowing in the circulation channel 21. In addition, the ink jet-type printing head 10 discharges ink droplets not continuously but at a desired timing, so the heated ink in the pressure generating chamber 11 may be cooled since the ink in the pressure generating chamber 11 is not supplied till next ink droplets are discharged. However, in this embodiment, the circulation channel 21 that flows a heated ink in parallel to the pressure generating chamber 11 is provided, so the ink in the pressure generating chamber 11 may be heated by the ink flowing in the circulation channel 21.

In addition, for example, it may also be possible that the pressure generating chamber 11 is used as a circulation channel by itself, in other words that one end of the pressure generating chamber 11 is connected to the manifold and the other end thereof is connected to the circulation liquid chamber 20. However, in this configuration, when a pressure of the pressure generating chamber 11 is changed by means of the piezoelectric element, the pressure in the pressure generating chamber 11 escapes toward the circulation liquid chamber 20, so ink droplets may be not discharged from the nozzle opening 13. In this embodiment, the circulation channel 21 is provided between adjacent pressure generating chambers 11, thus controlling the pressure created in the pressure generating chamber 11 so as not to directly escape to the circulation liquid chamber 20, thereby discharging ink droplets excellently.

Also, in the case that the circulating channel allowing a flow in an installation direction of the pressure generating chamber 11 is provided, a temperature gradient is generated toward the installation direction of the pressure generating chamber 11 (or, a flow direction in the circulation channel), so every pressure generating chamber 11 may not be heated at a uniform temperature. In this embodiment, the circulation channel 21 to flow the ink is provided between adjacent pressure generating chambers 11 in a direction orthogonal to the installation direction of the pressure generating chamber 11, so the ink in all pressure generating chambers 11 may be heated at substantially the same temperature, so it is possible to discharge ink droplets of the same temperature and the same discharging characteristics from all nozzle openings 13.

In addition, the circulation channel 21 circulates an ink in communication with the circulation liquid chamber 20 and the manifold 18, so it is possible to prevent ink components from sinking in the manifold 18 just before the pressure generating chamber 11. In other words, it is possible to supply the uniform ink, in which ink components do not sink, near to the pressure generating chamber 11, thereby improving printing characteristics.

Second Embodiment

Figure 3:
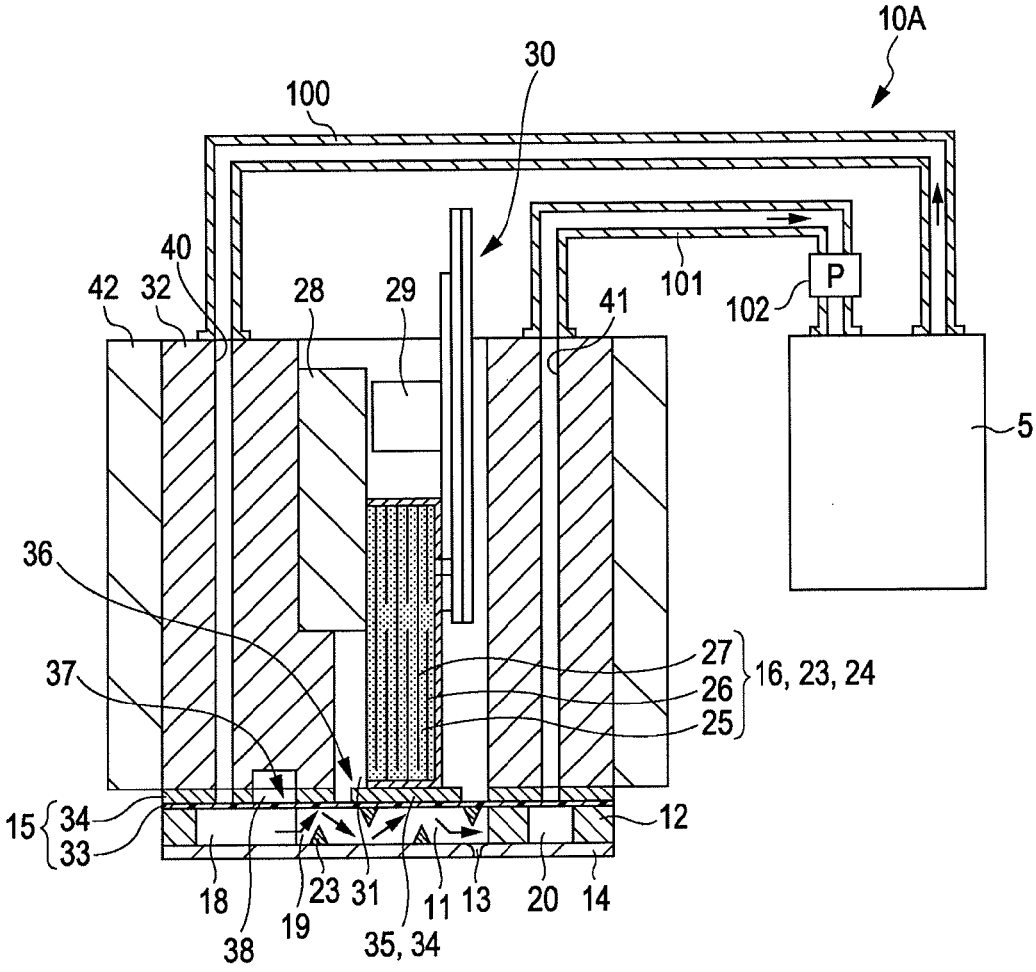
FIG. 3 is a sectional view showing a printing head according to a second embodiment.

FIG. 3 is a sectional view showing an ink jet-type printing head, which is one example of a liquid ejecting head according to a second embodiment of the invention. Also, the same elements as in the first embodiment are given the same reference symbols, and repeated explanation thereof is omitted.

As shown in FIG. 3, the ink jet-type printing head 10A of this embodiment has a plurality of protrusions 23 protruded on an inner surface of the circulation channel 21 in a direction orthogonal to a line directed from the manifold 18 to the circulation liquid chamber 20.

The protrusion 23 of this embodiment has a triangular section, and four protrusions are arranged at substantially regular intervals such that two protrusions are formed on an inner surface of the nozzle plate 14 toward the circulation channel 21 and two protrusions are formed toward the vibration plate 15. The protrusions 23 may also be provided at a side of the circulation channel 21, or a side of the barrier 17 toward the circulation channel 21.

By preparing such protrusions 23, a surface area contacted with the ink flowing in the circulation channel 21 from the manifold 18 to the circulation liquid chamber 20 is increased, so it is possible to improve thermal conductivity for heating the ink in the pressure generating chamber 11 by means of the heated ink. In this way, the ink in the pressure generating chamber 11 may be efficiently heated to a desired temperature within a short time by means of the heated ink flowing in the circulation channel 21.

Third Embodiment

Figure 4A:
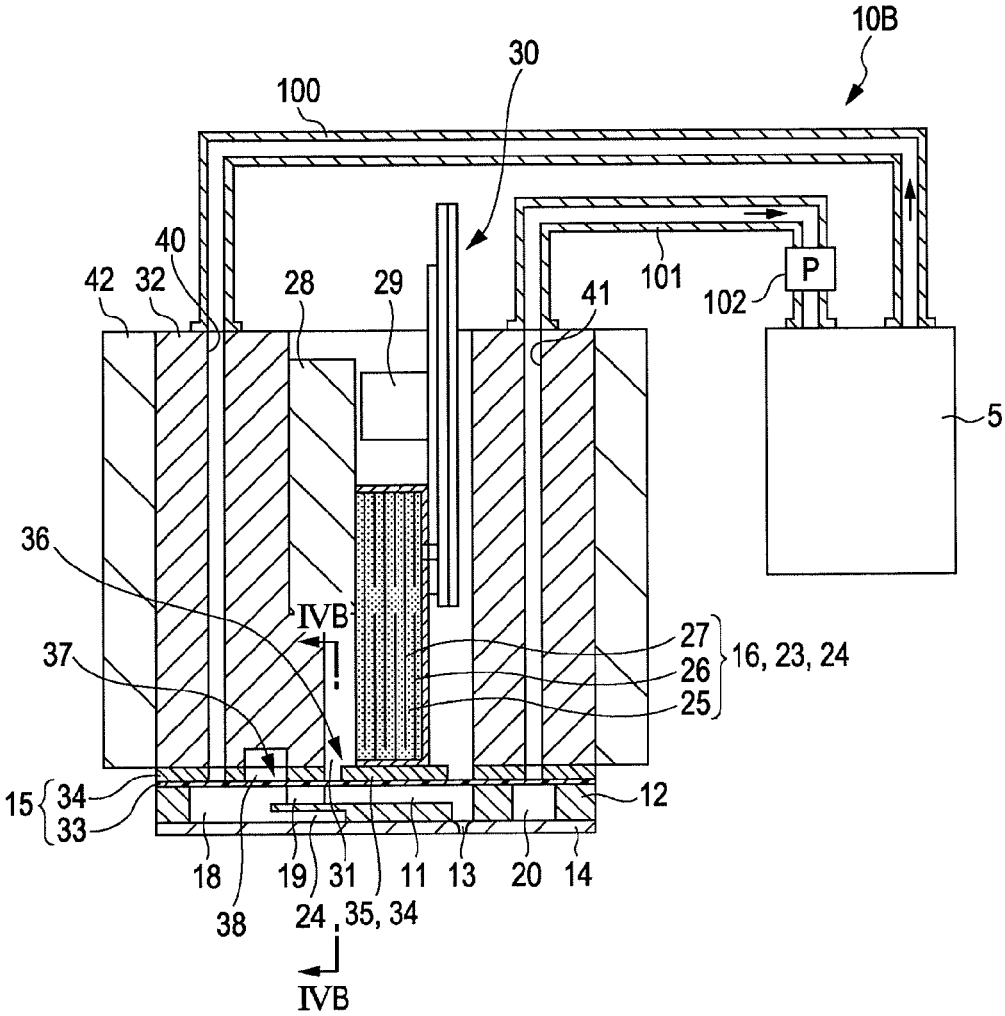
FIGS. 4A and 4B are sectional views showing a printing head according to a third embodiment.
Figure 4B:
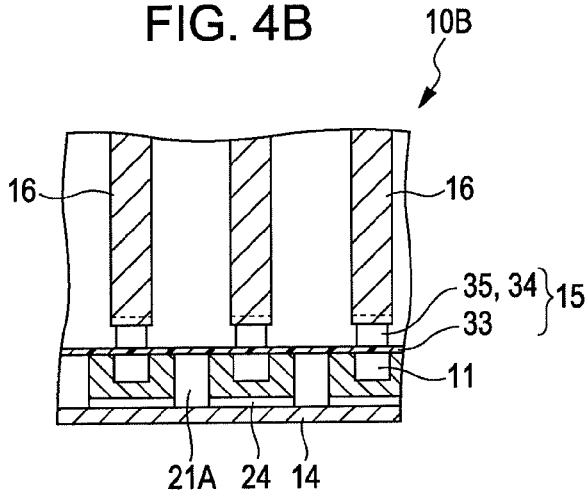

FIGS. 4A and 4B are sectional views showing an ink jet-type printing head, which is an example of a liquid ejecting head according to a third embodiment of the invention. Also, the same elements as in the first embodiment are endowed with the same reference symbols, and repeated explanation thereof is omitted.

As shown in FIGS. 4A and 4B, in the ink jet-type printing head 10B of this embodiment, the circulation channel 21A has an extending installation portion 24 extending to a region facing the pressure generating chamber 11 in a thickness direction of the channel-forming substrate 12.

In this embodiment, the extending installation portion 24 is installed in direct communication with the manifold 18 to form a space to be integral over the pressure generating chamber 11 installed similarly to the manifold 18. In other words, the extending installation portion 24 is installed to communicate with an adjacent circulation channel in an installation direction of the pressure generating chamber 11.

By installing the extending installation portion 24 at the circulation channel 21A as mentioned above, the ink in the pressure generating chamber 11 may be efficiently heated within a shorter time by means of the heated ink flowing in the extending installation portion 24.

It is also possible that the protrusions 23 of the second embodiment are provided to the circulation channel 21A having the extending installation portion 24 of the embodiment so that the ink in the pressure generating chamber 11 may be efficiently heated within a much shorter time.

In addition, in this embodiment, the extending installation portion 24 is provided at the manifold 18 so that the extending installation portion 24 is directly communicated with the manifold 18, but an installation location of the extending installation portion 24 is not limited thereto, and the extending installation portion 24 may be provided for example at a center of the length direction of the pressure generating chamber 11, independently from the manifold 18 or the circulation liquid chamber 20. Also, the extended installation portion 24 may be provided to the circulation liquid chamber 20 such that the extended installation portion 24 is directly communicated with the circulation liquid chamber 20.

Other Embodiments

Heretofore, embodiments of the invention have been described, but the invention is not limited to the above description.

For example, in the first embodiment, the ink of the liquid storage 5 is circulated in the ink jet-type printing head 10 to 10B by means of the pressure of the pump 102 provided at the retrieving pipe 101. However, without being limited thereto, it is also possible that a liquid flow forming unit such as a pump for forming a flow of ink from the manifold 18 via the circulation channel 21, 21A to the circulation liquid chamber 20 may be provided to the channel of the ink jet-type printing head 10 to 10B. For example, in one embodiment, the vibration plate 15 is installed in one side of the circulation channel 21, 21A, and the circulation channel 21 is sealed by the vibration plate 15. Thus, an actuator for deforming the vibration plate 15 enclosing the circulation channel 21 may be provided as a pump. This actuator may employ a piezoactuator using a piezoelectric element or a so-called electrostatic actuator for discharging liquid droplets from the nozzle opening 13 by deforming the vibration plate by an electrostatic force generated between the vibration plate and the electrode. In addition, it is also possible to install a heating element in the circulation channel 21, 21A so that a flow of ink is formed from the manifold 18 to the circulation liquid chamber 20 by means of bubbles generated by heating of the heating element.

Further, in one embodiment, the piezoelectric element 16 is described as a pressure generating unit for causing pressure change in the pressure generating chamber 11, but the invention is not limited thereto. For example, it is possible to use a vibration-type bent piezoelectric element in which a lower electrode, a piezoelectric material layer and an upper electrode are stacked on a vibration plate, a bubble type unit which liquid droplets are discharged from the nozzle opening by bubbles generated by the heating of the heating element to dispose a heating element in the pressure generating chamber, or an electrostatic actuator for discharging liquid droplets from the nozzle opening by deforming a vibration plate by an electrostatic force generated between the vibration plate and the electrode.

Figure 5:
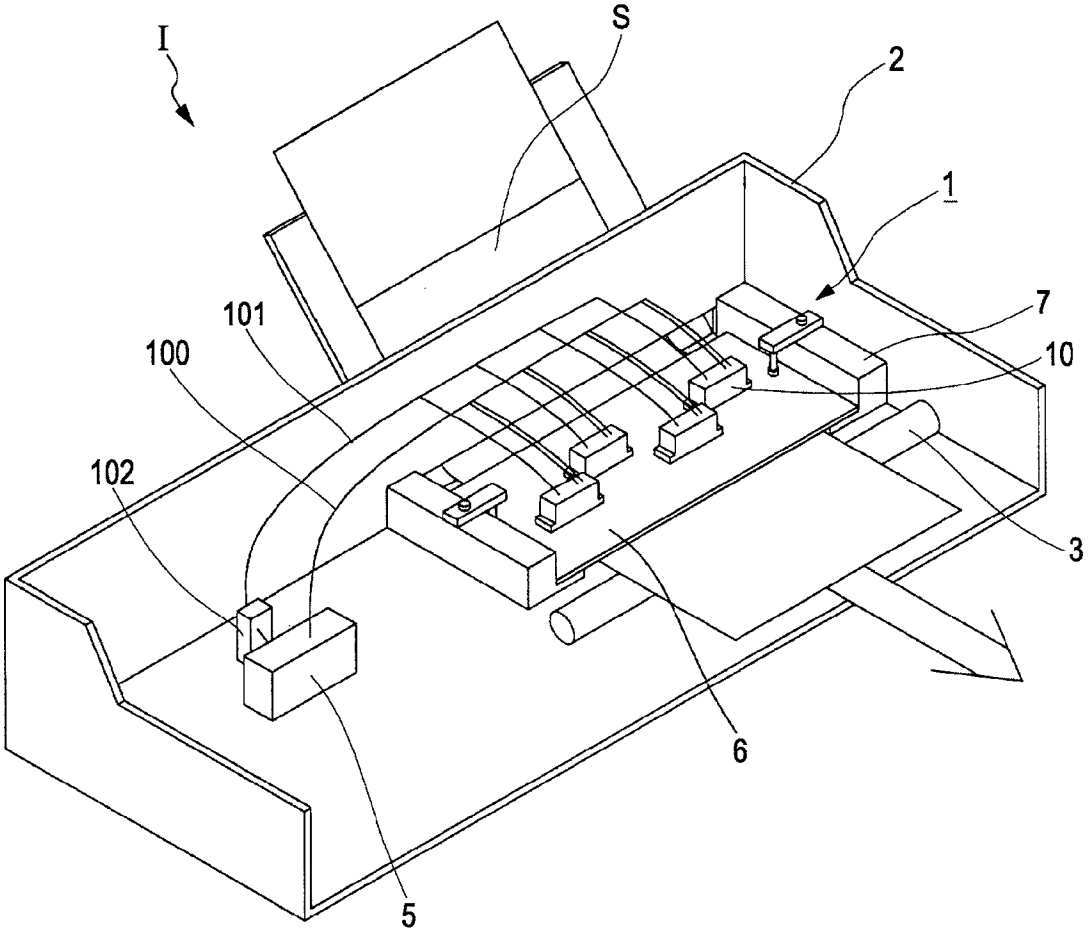
FIG. 5 is a schematic configuration view showing a printing apparatus according to one embodiment.

Also, the aforementioned ink jet-type printing head 10 to 10B constitutes a part of an ink jet-type printing head unit and is loaded on an ink jet-type record apparatus. FIG. 5 is a schematic view showing an example of the ink jet-type printing apparatus.

The ink jet-type printing apparatus of this embodiment has the ink jet-type printing head 10 to 10B fixed to a body so that an ejection target such as a recording paper is transported in a direction orthogonal to the installation direction of the nozzle opening 13 to print on the ejection target, which is a so-called line ink jet-type printing apparatus.

As shown in FIG. 5, the ink jet-type printing apparatus I includes an ink jet-type printing head unit 1 having the ink jet-type printing head 10, a body 2, a feeding roller 3 serving as a transfer unit, and a liquid storage 5.

The ink jet-type printing head unit 1 (hereinafter, referred to as a head unit 1) is equipped with a frame member 7 attached to a base plate 6 to which a plurality of ink jet-type printing heads 10 are supported, so the head unit 1 is fixed to the body 2 via the frame member 7.

In addition, the feeding roller 3 is installed to the body 2. The feeding roller 3 transports a recording sheet S serving as an ejection target such as a paper fed to the body 2 so that the recording sheet S passes over an ink discharging surface of the ink jet-type printing head 10.

Also, as described above, to each ink jet-type printing head 10, the liquid storage 5 fixed to the body 2 to store ink is connected via the supply pipe 100 and the retrieve pipe 101 such as flexible tubes. The ink is supplied from the liquid storage 5 to each ink jet-type printing head 10 via the supply pipe 100, and the ink not discharged from the ink jet-type printing head 10 is retrieved to the liquid storage 5 via the retrieving pipe 101. In addition, the pump 102 is installed in the middle of the retrieving pipe 101, so the ink from the liquid storage 5 is circulated due to the pressure of the pump 102.

In this ink jet-type printing apparatus I, while the recording sheet S is transported in a transporting direction by the feeding roller 3, ink is discharged by the ink jet-type printing head 10 of the head unit 1 to print an image or the like on the recording sheet S.

Also, though one head unit 1 having the ink jet-type printing head 10 is provided to the ink jet-type printing apparatus I in the above embodiment, two or more head units 1 may also be loaded on the ink jet-type printing apparatus I. In addition, the direct ink jet-type printing head 10 may be loaded on the ink jet-type printing apparatus I.

Also, though a line ink jet-type printing apparatus used for printing is illustrated so that the ink jet-type printing head 10 is fixed and the recording sheet S is transported, the invention may be applied to another type of ink jet-type printing apparatus. For example, the ink jet-type printing head 10 may be loaded on a carriage that moves in a direction (a main scanning direction) orthogonal to a transporting direction of the recording sheet S so that the ink jet-type printing head 10 is moved in the main scanning direction while printing, which is a so-called serial ink jet-type printing apparatus, and the invention may be applied thereto.

In addition, though the ink jet-type printing apparatus that the liquid storage is fixed to the body is illustrated in this embodiment, the invention is not limited thereto. For example, the invention may be applied to an ink jet-type printing apparatus in which a liquid storage such as an ink cartridge is fixed to each ink jet-type printing head or each ink jet-type printing head unit.

Further, though the ink jet-type printing apparatus is described in this embodiment as an example of the liquid ejecting apparatus, the invention is provided for all kinds of liquid ejecting apparatuses provided with a liquid ejecting head, and the invention may be applied to liquid ejecting apparatuses having a liquid ejecting head that ejects liquid other than ink. For example, other liquid ejecting heads include various printing heads used in an image printing apparatus such as a printer, a color material ejecting head used for making a color filter of a liquid crystal display, an electrode material ejecting head used for forming an electrode such as organic EL display and FED (Field Emission Display), a bio organism ejecting head used for making a bio chip, and so on.

What is claimed is:

1. A liquid ejecting head, comprising:

a liquid channel, comprising:

one or more pressure generating chambers, each of the pressure generating chambers being in communication with a respective nozzle opening configured to eject liquid; and a first liquid chamber disposed at a first end of the pressure generating chambers and in communication with all of the one or more pressure generating chambers;

one or more pressure generating units, each configured to change a pressure in a respective one of the pressure generating chambers so that liquid is discharged from the respective nozzle opening;

a heating unit for heating liquid in the liquid channel at an upstream of the pressure generating chambers;

a second liquid chamber disposed at a second end of the pressure generating chambers; and a circulating channel disposed adjacent to one of the pressure generating chambers or between two of the pressure generating chambers, the circulating channel being disposed in parallel with the pressure generating chambers to provide communication between the first liquid chamber and the second liquid chamber while bypassing the pressure generating chambers.

2. The liquid ejecting head according to claim 1, further comprising a protrusion which protrudes in a direction orthogonal to a direction along which the liquid is to flow, wherein the protrusion is disposed within the circulating channel.

3. A liquid ejecting head unit, which includes at least two liquid ejecting heads according to claim 2.

4. A liquid ejecting apparatus, which includes the liquid ejecting head according to claim 2.

5. The liquid ejecting head according to claim 1, wherein the pressure generating chamber is configured as a concave portion at one side of a channel-forming substrate without penetrating through the channel-forming substrate in a thickness direction, wherein the pressure generating chamber has a concave shape opening at one side, and wherein the circulating channel has an extending installation portion extending to a region facing the pressure generating chamber in a thickness direction of the channel-forming substrate.

6. A liquid ejecting head unit, which includes at least two liquid ejecting heads according to claim 5.

7. A liquid ejecting apparatus, which includes the liquid ejecting head according to claim 5.

8. The liquid ejecting head according to claim 1, wherein the circulation channel is disposed between two of the pressure generating chambers, wherein the two of the pressure generating chambers are adjacent to each other.

9. A liquid ejecting head unit, which includes at least two liquid ejecting heads according to claim 8.

10. A liquid ejecting apparatus, which includes the liquid ejecting head according to claim 8.

11. The liquid ejecting head according to claim 1, wherein the pressure generating chamber group comprises two pressure generating chambers.

12. A liquid ejecting head unit, which includes at least two liquid ejecting heads according to claim 11.

13. A liquid ejecting apparatus, which includes the liquid ejecting head according to claim 11.

14. The liquid ejecting head according to claim 1, further comprising a liquid flow forming unit configured to generate a flow of liquid from the first liquid chamber through the circulation channel to the second liquid chamber, wherein the liquid flow forming unit is disposed in the liquid channel.

15. A liquid ejecting head unit, which includes at least two liquid ejecting heads according to claim 14.

16. A liquid ejecting apparatus, which includes the liquid ejecting head according to claim 14.

17. A liquid ejecting head unit, which includes at least two liquid ejecting heads according to claim 1.

18. A liquid ejecting apparatus, which includes the liquid ejecting head unit according to claim 17.

19. A liquid ejecting apparatus, which includes the liquid ejecting head according to claim 1.

* * * * *